United States Patent [19]

Nausedas

[11] Patent Number: 4,519,504

[45] Date of Patent: May 28, 1985

[54] WICKET BAG PACKET

[75] Inventor: Joseph A. Nausedas, Oak Forest, Ill.

[73] Assignee: Union Carbide Corporation, Danbury, Conn.

[21] Appl. No.: 649,292

[22] Filed: Sep. 11, 1984

Related U.S. Application Data

[63] Continuation of Ser. No. 454,482, Dec. 29, 1982.

[51] Int. Cl.[3] ..... B65D 71/00

[52] U.S. Cl. ..... 206/554; 53/385; 206/449; 206/526; 211/57.1; 221/26

[58] Field of Search ..... 24/605; 72/335; 53/385, 53/390, 396; 206/493, 494, 449, 526, 451, 554, 559; 211/57.1; 221/26; 248/100; 281/21 R; 402/8, 13, 19, 21, 60, 68, 69

[56] References Cited

U.S. PATENT DOCUMENTS

| | | | |
|---|---|---|---|
| 826,656 | 7/1906 | Gerow | 402/8 |
| 828,974 | 8/1906 | Schmidmer | 402/8 |
| 2,006,925 | 7/1935 | Klemp | 72/335 |
| 3,184,055 | 5/1965 | Davis et al. | 206/493 |
| 3,383,786 | 5/1968 | McIntosh | 402/8 |
| 3,747,298 | 7/1973 | Lieberman | 248/100 |
| 3,763,627 | 10/1973 | Kupcikevicius | 53/189 |
| 3,770,134 | 11/1973 | Kupcikevicius | 211/57.1 |
| 3,777,930 | 12/1973 | Ericson | 221/26 |
| 3,783,580 | 1/1974 | Raudys | 53/29 |
| 3,918,589 | 11/1975 | Nausedas | 211/57.1 |
| 4,262,803 | 4/1981 | Nausedas | 206/554 |
| 4,277,930 | 7/1981 | Nausedas | 53/396 |
| 4,300,848 | 11/1981 | Waegemann | 402/13 |

FOREIGN PATENT DOCUMENTS

| | | | |
|---|---|---|---|
| 689779 | 9/1930 | France | 402/21 |
| 1382299 | 11/1964 | France | 206/493 |
| 177906 | 4/1922 | United Kingdom | 402/13 |

*Primary Examiner*—George E. Lowrance
*Assistant Examiner*—Jimmy G. Foster
*Attorney, Agent, or Firm*—John R. Doherty

[57] ABSTRACT

A wicket bag packet for use in conjunction with automatic and semi-automatic packaging apparatus comprises a stack of flattened flexible packaging bags, each of the bags having an open end and having wicket holes adjacent to the open end, and a wicket including a substantially rigid upper portion and a lower portion, the lower portion preferably being a flexible, tubular binding member extending upwardly through the wicket holes in each of the bags and joining with the substantially rigid upper portion of the wicket to form a continuous flexible loop for holding the packaging bags together in the stack.

4 Claims, 8 Drawing Figures

WICKET BAG PACKET

This application is a continuation of prior U.S. application Ser. No. 454,482, filed 12/29/82.

DESCRIPTION

1. Technical Field

The present invention relates to the packaging of articles such as food products and the like in flexible packaging bags made from thin plastic sheet material. More specifically, the present invention relates to an improved wicket bag packet containing a number of flexible packaging bags for use in automatic and semi-automatic packing operations. In a more specific aspect, the present invention is directed to an improved wicket bag packet which contains a significantly greater number of packaging bags than heretofore possible, thereby facilitating the packaging operation and improving the efficiency thereof.

2. Background Art

Packaging operations in industry are of significant import and interest towards promoting the rapid, efficient and economical packaging of products for the market. Food packaging generally and particularly the bakery and meat packaging industry require additionally strict maintenance of sanitary conditions. Automatic or semi-automatic packaging techniques have been developed towards achievement of these desired goals. Semi-automatic packaging techniques, that is to say, those requiring the cooperation of a human operator with a machine, are uniquely of interest to the bakery and meat packing industry since the products being packaged frequently are not exactly alike as to size, shape and weight, a circumstance militating against fully automatic packing. To the extent that food products, such as bakery goods, meat cuts and the like are at least sufficiently alike in size, shape and weight in a given series to permit the use of packaging bags of the same size and material, some degree of automation in the packaging operation is possible.

U.S. Pat. No. 3,763,627 to Kupcikevicius et al. is illustrative of such semi-automatic packaging techniques and apparatus. As disclosed therein, the packaging operation is carried out by placing a number of flexible packaging bags adjacent to the packaging apparatus which is equipped with an air blower. The blower directs a stream of air into the open end of each bag in order to inflate the bags and facilitate entry of articles such as bakery goods, meat cuts or other food products. The flexible packaging bags are arranged in flatwise contiguous manner one on top of the other to form a stacked supply of bags which is held together by a wicket. Each bag is provided with two wicket holes which are maintained in substantial registration with the wicket holes in respectively contiguous bags in the stack. The wicket extends through the wicket holes in each bag and is usually secured at the bottom end of the stack in order to hold the same neatly in a bundle. Various types of wickets can be used such as those disclosed, for example, in U.S. Pat. Nos. 3,770,134 and 3,777,930. A stacked and wicket held supply of packaging bags such as described herein is commonly referred to in the industry as a "wicket bag packet".

During the packaging operation, a wicket bag packet is placed on a flat surface or table adjacent to the packaging station. The discharge end of the blower is then located adjacent to the bag packet with the nozzle resting on top of the wicket. The wicket is formed at its center with a retaining element which carries the weight of the nozzle and which in turn bears down on top of the bag packet to hold the same in place. The packaging apparatus is usually provided with locking devices such as sockets or the like, which receive and hold the ends of the wicket. This arrangement assures proper alignment of the bags with respect to the discharge end of the nozzle. The blower directs a stream of air in the direction of the bag packet which opens and inflates the topmost bag. The article to be packaged such as precut meat is then placed inside the inflated bag by the operator. The article filled bag is easily removed from the wicket by simply pulling the bag in an opposite direction. This immediately exposes the next contiguous bag in the bag packet and the whole operation is repeated again in sequence.

It will be readily apparent from the above description that the size and particularly the height of the wicket bag packet must necessarily be limited to some practical dimension which will not interfere with or obstruct operation of the packaging apparatus. For example, where it is desirable to incorporate a large number of packaging bags in a single bag packet for purposes of efficiency or convenience, it may not be possible owing to the increased size or height of the bag packet to properly locate the blower nozzle on top of the wicket. Another serious problem has been that whenever the number or "count" of individual bags employed in the bag packet is significantly increased, the weight of the packet increases and the packet may become bulky and difficult to handle. The added height of the stack of bags frequently leads to difficult problems since the locking devices used to hold the wickets in place may not be able to sustain the added force applied to them. Accordingly, the wickets may loosen and allow the bags to move in a direction away from the blower nozzle. As a consequence, it may be necessary at times to stop the packaging operation at least temporarily to realign the bags.

It is therefore an important object of the present invention to provide an improved wicket bag packet for use in automatic and semi-automatic packaging operations.

Another more specific object of the present invention is to provide an improved wicket bag packet which contains a significantly greater number of packaging bags than heretofore possible without at the same time causing any serious misalignment problems.

Still another object of the present invention is to provide an improved wicket bag packet which permits a number of the packaging bags to be taken from the bag packet at one time and placed in position ready for use at the packaging station while the remaining bags in the bag packet are held apart in a separate storage area.

DISCLOSURE OF THE INVENTION

The present invention is directed to an improved wicket bag packet for use in automatic and semi-automatic packaging operations. In a broad aspect, the present invention comprehends a wicket bag packet comprising, in combination:

a stack of flattened flexible packaging bags, each of the bags having an open end and having wicket holes provided adjacent to the open end, and a wicket for holding the packaging bags together in the stack of bags, the wicket including a substantially rigid upper portion and a lower portion, the lower portion of the wicket being contiguous with the upper portion and extending through the wicket holes provided in each bag, the upper portion of the wicket extending outwardly beyond the stack of packaging bags.

In a preferred embodiment of the present invention, the wicket includes a substantially rigid upper portion having elongated leg members which are adapted to pass through the wicket holes in each of the bags. The lower portion of the wicket is preferably a flexible, tubular binding member extending upwardly through the wicket holes in each of the bags and joining with the legs on the upper portion of the wicket.

The substantially rigid upper portion of the wicket also preferably includes a straight horizontal center section which is adapted to bear down on a part of the topmost bag adjacent to its open end for holding the bags firmly in place during the bag opening and filling operation.

Also in a preferred embodiment of the present invention, each bag in the stack has a lower ply and an upper ply which is made shorter than the lower ply so as to clear the lower ply and provide a lip portion adjacent to the open end of the bag. A pair of wicket holes are provided in the lip portion for receiving the elongated legs on the lower portion of the wicket.

The wicket bag packet according to the present invention is especially suited for use in conjunction with the packaging method and apparatus disclosed and claimed in the copending application of J. A. Nausedas, Ser. No. 454,481, filed Dec. 29, 1982 and assigned to the common assignee hereof. In that packaging method and apparatus, the substantially rigid upper portion of the wicket is held in place at the packaging station by a wicket holder which aligns the bags with their open end facing the discharge nozzle of an air blower. The bag packet is placed inside a storage area located beneath a packaging table. The packaging table is removable so that the operator can periodically select a number of the bags from the stack and transfer the bags to the packaging station while still retained by the wicket.

The wicket holder used in the apparatus is preferably an elongated, rectangular block having open grooves provided in its side wall for receiving and positioning the rigid wicket. A U-shaped wicket retainer engages the side walls of the holder block so as to close off the grooves and retain the rigid wicket in place inside the wicket holder.

BRIEF DESCRIPTION OF THE DRAWING

The present invention will now be described in greater detail with particular reference to the preferred embodiments thereof which are illustrated in the accompanying drawing wherein.

DETAILED DESCRIPTION

Figure 1:
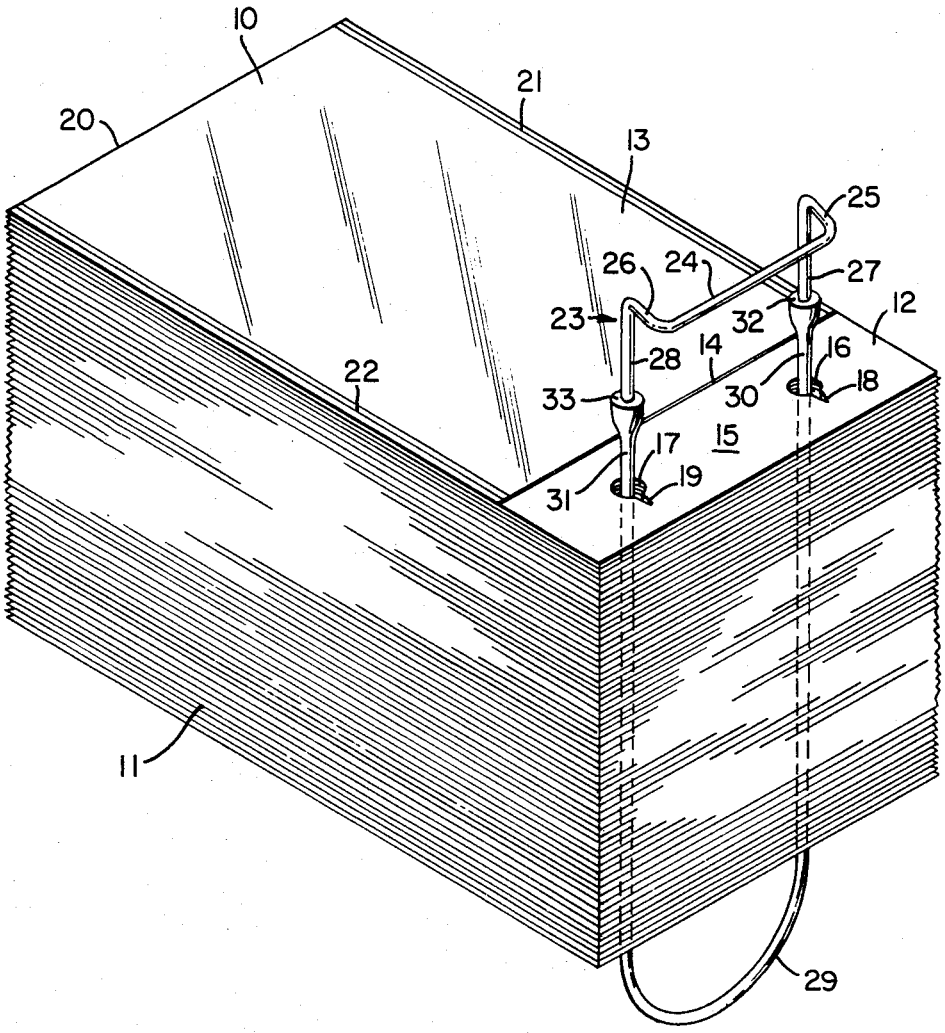
FIG. 1 is a perspective view of a wicket bag packet according to the present invention.

Referring to the drawing, a wicket bag packet according to the present invention is illustrated in FIG. 1. As shown, the bag packet includes a plurality of flattened, flexible packaging bags 10 which are arranged in a flatwise contiguous manner to form a stack a bags as indicated at 11. Each bag 10 is preferably made from a single sheet of plastic film material, e.g., polyethylene, polypropolene, etc., which is folded upon itself to form two plys, namely, a lower ply 12 and an upper ply 13. The ply 13 has a top edge 14 which is made deliberately short so as to clear the corresponding top edge of the lower ply 12 and thereby provide a lip portion 15 adjacent to the open end of each bag. A pair of wicket holes 16, 17 are formed in the lip portion 15 of each bag along with a tear slit 18, 19, respectively, for direction prone tearing of the lip portion 15. All of the wicket holes 16, 17 in the contiguous bags are maintained in substantial registration with one another throughout the bag stack 11. Each bag is closed at its bottom end 20 and is provided with two side seals 21, 22 by heat sealing or the like.

A rigid wicket 23 is provided in the bag packet for holding a number of the bags in position at the packaging station ready for use during the packaging operation. In a preferred form of the rigid wicket as illustrated in FIG. 1, the wicket is generally M-shaped with a straight center section 24 which turns upwardly at each end to define a pair of shoulders 25, 26. The shoulders 25, 26 are in turn joined by a pair of downwardly extending wicket legs 27, 28. The wicket 23 may be made from any rigid metal, e.g., aluminum or steel, or it may be molded from a rigid plastic material.

A flexible, tubular, U-shaped wicket binding member 29 is also provided for securing together the whole bag stack 11. The flexible binding member 29 has two leg portions 30, 31 which extend from the bottom of the stack through the pairs of wicket holes 16, 17 in all the bags. Preferably, the length of the binding member 29 is greater than the height of the stacked supply of bags so that a substantial portion of the binding member extends beyond the top or bottom or both of the bag stack. The open ends 32, 33 of the respective leg portions 30, 31 are pressed, heat sealed, glued or otherwise firmly attached or joined to the legs 27, 28 of the rigid wicket 23. Thus, it will be seen that the flexible binding member 29 taken in conjunction with the rigid wicket 23 provides a continuous flexible binding loop which serves to effectively hold the whole stack of bags in a neatly arrranged and easily handled bundle. The binding member may be solid as well as tubular and may be made from any number of flexible materials such as polyethylene, vinyl, rubber and the like.

It should be noted at this point that the width of the rigid wicket 23 is chosen such that two wicket legs 27, 28 extend freely through the pair of wicket holes 16, 17 provided in each of the packaging bags. However, it is not necessary to place the legs 27, 28 of the wicket down through the wicket holes 16, 17 in each of the bags during the time when the bag packet is being handled, shipped or placed in storage. The rigid wicket 23 may hang freely on top of the bag packet and serves as a convenient handle for carrying the packet. The flexible binding member 29 attached to the rigid wicket 23 at the same time holds together the entire bag stack.

The wicket bag packet of the present invention is especially suited for use in a packaging apparatus of the type illustrated in FIGS. 2-7, inclusive. As shown, the apparatus consists of a frame 34 having an aft end 35 and a fore end 36. A flat horizontal base plate 37 is supported by the frame 34 at the bottom of the apparatus. Mounted pivotally on the aft end 35 of the frame 34 is an air supply blower assembly indicated at 38. This blower assembly 38 includes a housing 39 which encloses and supports a motor driven air blower 40. The housing 39 has a flat, elongated, substantially horizontal top surface 41 which forms part of a nozzle 42. The nozzle 42 is provided with an air discharge opening 43 at its outer end. A pivoted flapper 44 is mounted on the nozzle 42 adjacent to the discharge opening 43 for regulating the angle at which the air stream is directed from the nozzle 42. As shown more particularly in FIGS. 3 and 4, the blower assembly 38 can be raised to a substantially vertical position by pivoting the housing 39 on horizontal trunnions 45 disposed at the aft end 35 of the frame 34.

Figure 2:
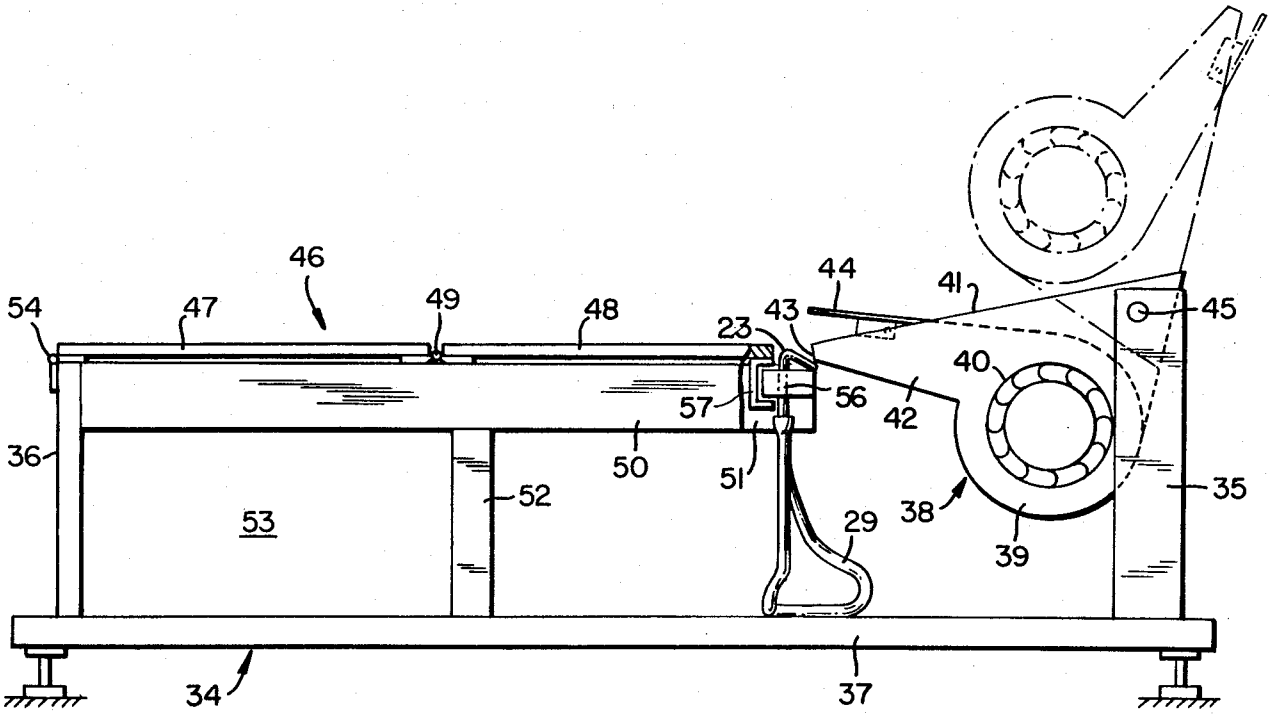
FIG. 2 is a side elevational view of packaging apparatus of the type to which the wicket bag packet of the present invention is especially suited, the apparatus being shown as it appears just prior to loading the storage area with a new bag packet, the air blower assembly also being shown in its raised or rotated position in phantom lines.
Figure 3:
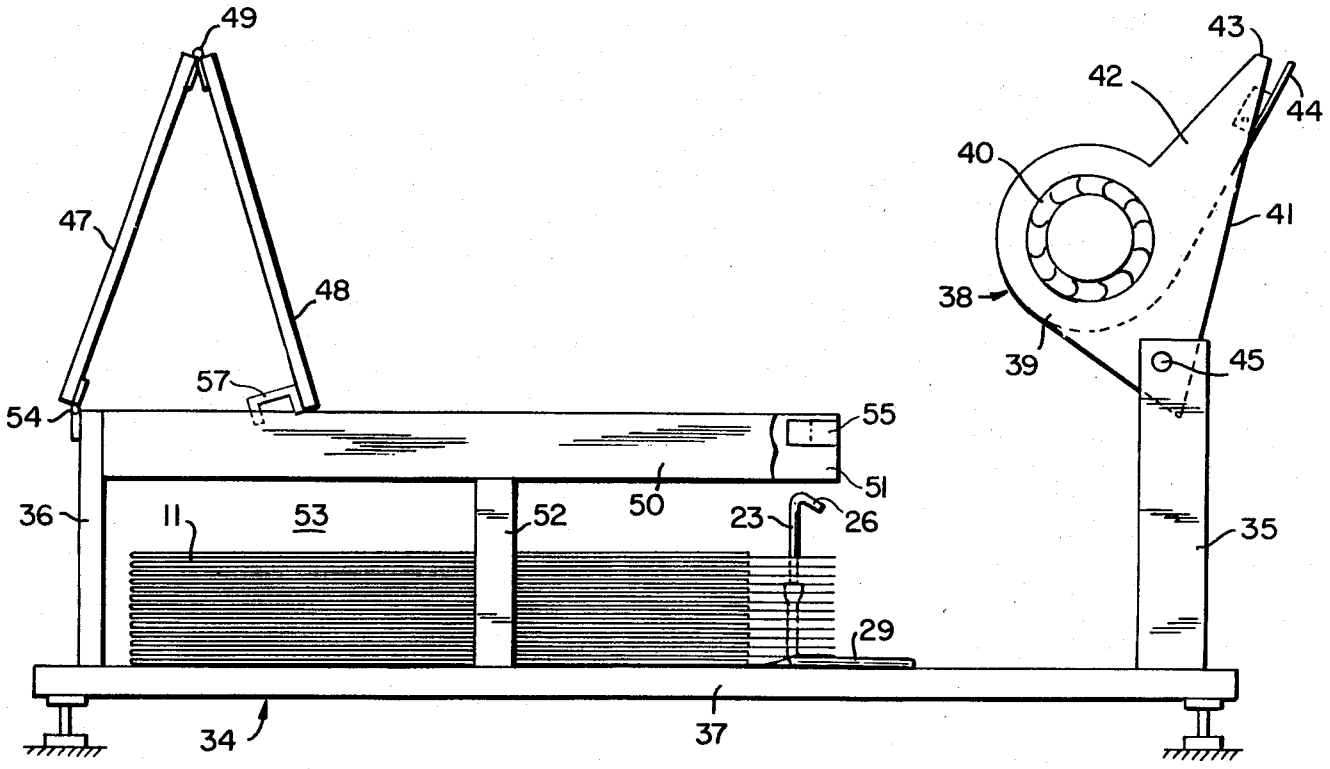
FIG. 3 is a side elevational view of the packaging apparatus shown in FIG. 2 as the apparatus appears during the loading operation with a new supply of bags placed inside the storage area and with the packaging table partly removed.
Figure 4:
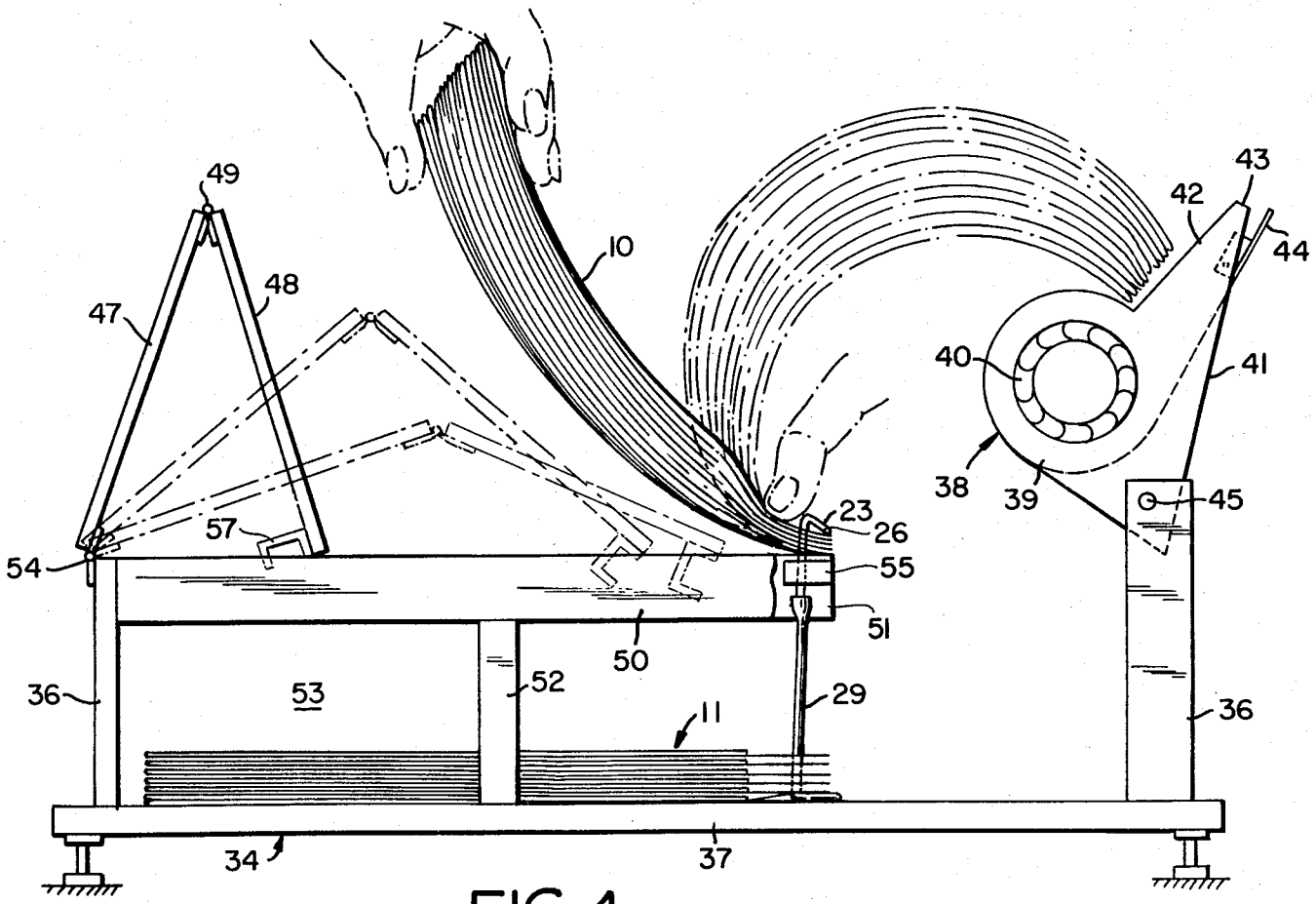
FIG. 4 is a similar view of the packaging apparatus illustrating the various steps involved in removing a selected number of bags from the storage area.

Mounted on top of the frame 34 and spaced above the base plate 37 is a flat packaging table indicated generally at 46. This table is made of two separate, elongated panels 47, 48, which are joined together by a hinge 49. The hinge 49 is secured to the underneath side of both panels 47, 48 along their adjoining lateral edges at the center of the table 46. The panels 47, 48 rest on top of two spaced apart, elongated, horizontal aprons 50, 51 as best shown in FIG. 2. The two aprons 50, 51 are each mounted to the fore end 36 of the frame 34 and are secured midway along their length by stanchions 52. The stanchions 52 are attached to and extend upwardly from the base plate 37. It will be seen from the above description that the two panels 47, 48, while they rest in position on top of the horizontal aprons 50, 51 provide a flat, elongated surface for supporting a number of packaging bags 10 on top of the apparatus as more particularly shown in the view of FIG. 7. It will also be seen from the above description that the frame 34 taken in conjunction with the table 46 and base plate 37, defines an open area 53 which is used for storing a wicket bag packet according to the present invention as shown in the views of FIGS. 2, 3, and 4.

Figure 7:
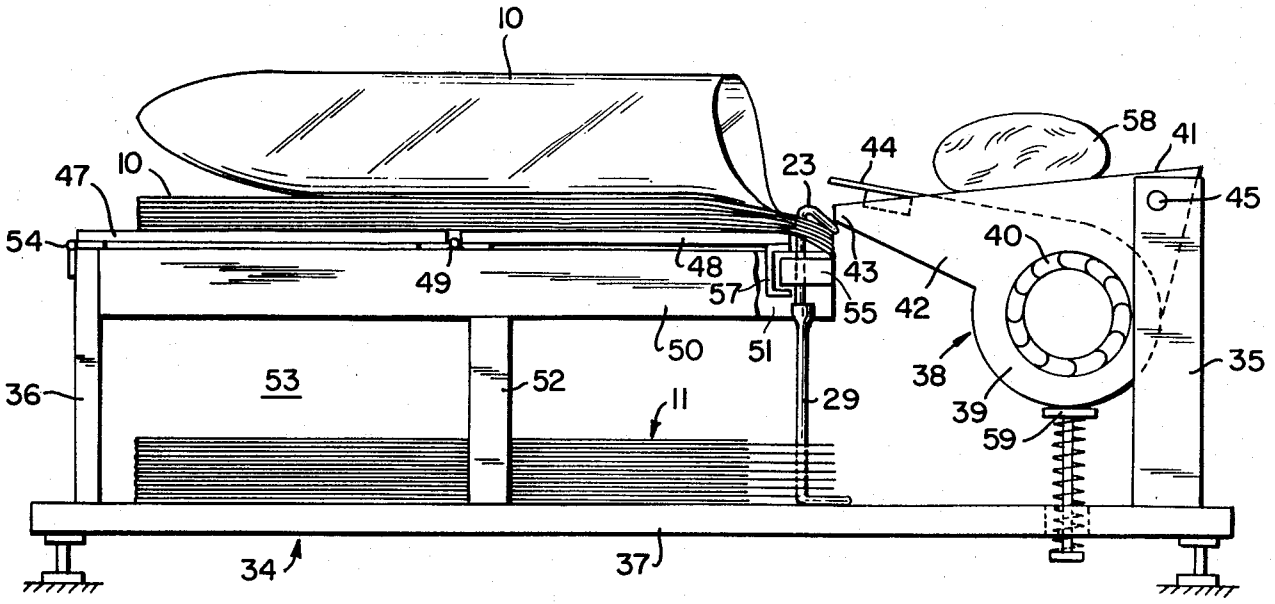
FIG. 7 is a view similar to FIGS. 1, 3 and 4 showing the apparatus as it appears during the packaging operation.

The two panels 47, 48 joined by the center hinge 49 are pivotally mounted to the fore end 36 of the frame 34 also by a hinge 54. The hinge 54 is secured to the underneath side of the forward panel 47 along its lateral edge disposed adjacent to the fore end 36. This structure enables the two panels 47, 48 to be removed from their normally horizontal position on top of the table 46 by simply lifting the two panels upwardly while they rotate about the center hinge 49 and simultaneously sliding the panels forward along the horizontal aprons 50, 51 in a manner depicted, for example, by the phantom lines in FIG. 4. It will also be noted that the overall length of the two panels 47, 48 is chosen such that when the blower assembly 38 is placed in its normally horizontal operating position as shown in FIGS. 2 and 7, the discharge end 43 of the nozzle 42 will clear the edge of the rear panel 48.

Figure 5:
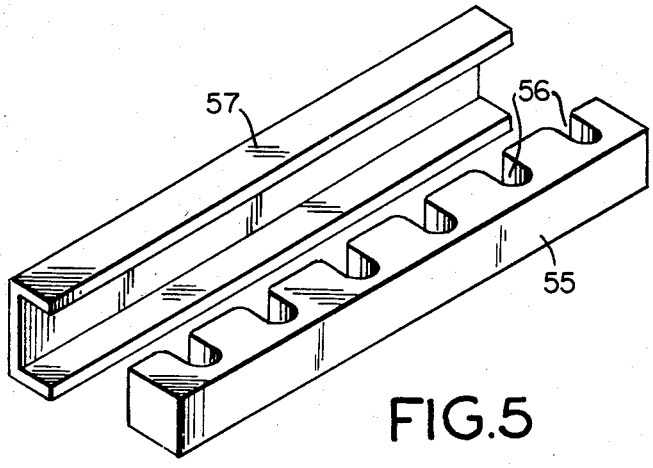
FIG. 5 is a perspective view of the grooved wicket holder block and U-shaped wicket retainer used in the apparatus.
Figure 6:
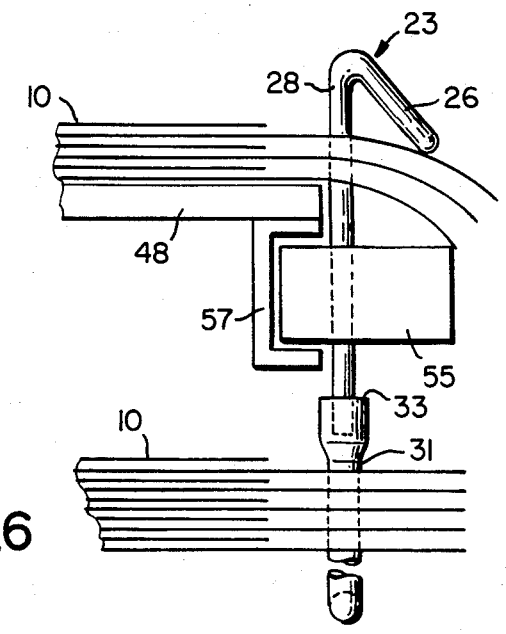
FIG. 6 is an enlarged detailed view of a portion of the apparatus showing the U-shaped retainer engaging the wicket holder block for holding the wicket in place.

As more particularly shown in FIGS. 5 and 6, a wicket holder 55 is provided for receiving the rigid wicket 23. The wicket holder 55 may be made from an elongated, rectangular block having formed within its side walls a series of spaced apart open grooves 56 for receiving and holding the rigid wicket 23. The wicket holder 55 is preferably mounted between the two aprons 50, 51 within the rearward end of the table 46 with the series of grooves 56 facing outwardly in a forward direction toward the fore end 36 of the frame 34. The wicket holder 55 may employ any number of grooves 56 to accommodate wickets of varying width commonly used in the industry. It will be seen that when the legs 27, 28 of a rigid wicket 23 are placed inside a particular pair of grooves 56 on the side wall of the wicket holder 55, the wicket 23 will be held in a substantially vertical position just in front of the discharge opening 43 of the nozzle 42.

A U-shaped wicket retainer 57 is also provided for retaining the rigid wicket 23 inside the wicket holder 55. The wicket retainer 57 is preferably attached to the underneath side of the rear panel 48 at a location such that when the panel 48 is placed down flat on top of the two horizontal aprons 50, 51, the U-shaped retainer 57 will automatically engage with the wicket holder 55 as best shown in the view of FIG. 6. The U-shaped retainer 57 is of a size such that its side walls will fit snugly over the wicket holder 55 to close off the series of grooves 56. It is important to note, however, that the U-shaped retainer 57 does not actually lock the wicket legs 27, 28 in the grooves 56 but rather only loosely holds the legs in place allowing the rigid wicket 23 freedom to move downwardly through the wicket holder 55 as the article filled bags are removed from the top of the packaging table 46.

Operation of the packaging apparatus involves first loading the storage area 53 with a bag packet such as shown in FIG. 3. Assuming the apparatus has been used previously to package articles such as bakery goods, meat cuts and the like, a wicket assembly from a prior bag packet including a rigid wicket 23 will remain in place inside the wicket holder 55 as shown for example in FIG. 2. To facilitate removal of the wicket and also permit ready access to the storage area 53, the air supply blower 39 is rotated clockwise about the trunnions 45 to an elevated position as shown by phantom lines in the drawing. This removes the discharge opening 43 of the nozzle 42 from its normally operating position on top of the rigid wicket 23. The two panels 47, 48 are removed from the table as described above by lifting the panels and moving them in a forward direction along the aprons 50, 51 toward the fore end 36 of the apparatus frame 34. The removal of the two panels 47, 48 also disengages the wicket retainer 57 mounted on the underneath side of the rear panel 48. The wicket 23 left behind from the prior bag packet is easily removed by lifting it off the wicket holder block 55 and it is then discarded. A new bag packet is loaded into the storage area 53 by dropping it through the open space left behind by the removal of the panels 47, 48. The whole packet is placed down flat on top of the horizontal base plate 37 with its rigid wicket 23 located just beneath the wicket holder block 55.

The operator then grasps the rigid wicket 23 in one hand lifting it upwardly beyond the bag packet while grasping with the other hand a selected number of packaging bags 10 to be used during the packaging operation. The bags are then removed from inside the storage area 53 by sliding the bags upward along the elongated wicket legs 27, 28 until the bags reach a point near the top of the rigid wicket 23. The legs 27, 28 of the rigid wicket 23 are then inserted into a pair of grooves 56 located on the side wall of the wicket holder block 55. With the fingers of one hand temporarily holding the rigid wicket 23 in place inside the holder block 55, the operator then lifts the packaging bags upwardly to a remote location away from the packaging table 46 as depicted by the phantom lines in FIG. 4. The two hingeably joined top panels 47, 48 are then lowered and moved backwardly, as depicted by phantom lines, along the aprons 50, 51, until they rest flat on top of the aprons. It will be seen in particular that during this step the two panels 47, 48 are placed underneath the packaging bags 10 held elevated by the operator's hand while at the same time the U-shaped wicket retainer 57 moves again into engagement with the wicket holder block 55. With the rigid wicket 23 held in place inside the holder block 55, the packaging bags 10 are now placed down flatwise on top of the two hingeably joined panels 47, 48 as shown in FIG. 7. The air blower assembly 38 is then lowered again by rotating it counterclockwise about the trunnions 45 until the discharge opening 43 of the nozzle 42 rests in its normally operating position on top of the straight center section 24 of the rigid wicket 23 (see FIG. 1). The air blower 40 is then activated and a continuous stream of air is directed from the discharge opening 43 of the nozzle 42. This air stream passes over the top of the packaging bags 10 placed on the table 46 and inflates the topmost bag as illustrated in FIG. 7. An article to be packaged such as a meat cut 58 is placed on top of the substantially horizontal top surface 41 of the blower housing 39, from whence the meat cut or other product may be easily directed into the open inflated bag. Guide means may also be provided on the top surface 41 for guiding the article into the bag as described in U.S. Pat. No. 3,763,627. Once the bag has been filed with the article, the filled bag is removed from the packaging table 46 by pulling the bag in a direction toward the fore end 36 of the frame 34. This causes the legs 27, 28 of the rigid wicket to tear through the bag lip 15 along the tear slits 18, 19 (see FIG. 1). The continuous stream of air from the discharge opening 43 of the nozzle 42 again inflates the next topmost bag 10 and the whole process for sequentially opening and filling the packaging bags is repeated again in sequence.

It is important to note that throughout the bag opening and filing operation as described above, the packaging bags 10 that are placed on top of the packaging table 46 are always maintained in proper alignment with the discharge opening 43 of the nozzle 42 by the co-action of both the holder block 55 and U-shaped wicket retainer 57. These two members when engaged serve to hold in place the rigid wicket 23 which in turn maintains alignment of the bags 10. In addition, it should be noted that the weight of the discharge opening 43 of nozzle 42 on top of the center section 24 of the rigid wicket 23 serves to hold down the bag lip 15 and thereby facilitate the bag opening operation. In this connection, the ability of the rigid wicket 23 to move freely downwardly through the holder block 55 as the bags 10 are filled and removed is important since this feature allows the wicket 23 to exert a substantially constant pressure at all times on the lip 15 of each bag 10. It may be desirable in some instances to also employ a spring-loaded support pad 59 located underneath the blower housing 39 in order to help in counter balancing the weight of the nozzle 42 on the wicket assembly.

An important feature of the present invention resides in the flexible, tubular, U-shaped binding member 29. As can be seen particularly in the view of FIG. 7, this flexible binding member 29 holds the stacked supply of packaging bags 11 which remain in the storage area 53 without adding the weight of these bags onto the rigid wicket 23 and otherwise interfering with the operations of the packaging apparatus. As indicated above, the length of the flexible binding member 29 is greater than the height of the stacked supply of bags so that a substantial portion of the binding member extends beyond the top or bottom or both of the stack. This allows the bags to rest completely on top of the base plate 13 without adding the weight of the bags to the wicket 23. Of course, the base plate 37 must also be positioned on the apparatus frame 34 such that for any given bag packet, the bags will be supported independently on the plate. It will be seen that virtually any number of packaging bags can be employed in a single bag packet. It will be further noted that more than one bag packet can be kept in the storage area, that is, two or more packets can be stored one on top of the other or side by side for convenience sake, although only one bag packet is used at a time during the packaging operation.

Figure 8:
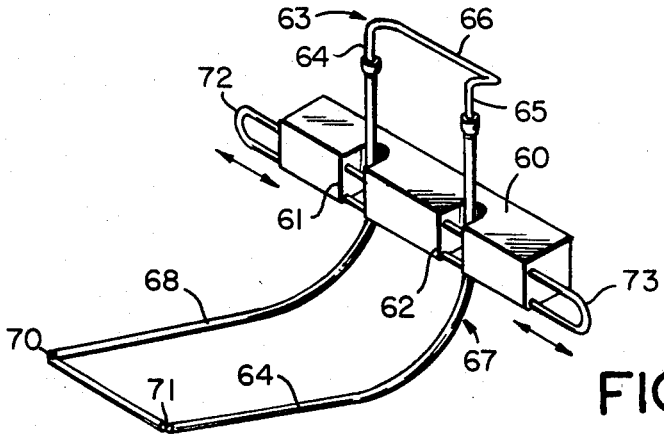
FIG. 8 is a perspective view of a part of the apparatus showing a modification of the present invention.

A modification of the present invention is shown in FIG. 8. In this modification, a wicket holder block 60 is provided with at least two open grooves 61, 62 in its side wall for receiving and holding the substantially upper portion of a wicket 63. The upper portion of this wicket 63 is rigid and has elongated legs 64, 65 and a straight center section 66. The lower portion of the wicket 63 is a substantially U-shaped tubular binder member 67 having elongated leg portions 68, 69 which are adapted to extend from the bottom of a bag packet through the wicket holes in each bag as described hereinabove. The leg portion 68, 69 also join at their upper ends with the elongated legs 64, 65 provided on the upper portion of the wicket 63. The U-shaped binder member 67 may be made from a flexible, semi-rigid or rigid material. In the case where the binder member 67 is made from a semi-rigid or rigid material, the lower end of the binder member 67 may be formed by bending, crimping or the like or more preferably by cutting the tube at two places as at 70, 71, the cuts extending only partly across the tube, e.g., about 180°, and then bending the tube at these points to form the substantially U-shaped tubular binder member 67. The binder member 67 may of course vary somewhat in its configuration from a substantially U-shaped member having square corners to one having smooth rounded corners as essentially shown in FIG. 1. The center portion of the binder member 67 is preferably made of sufficient lengths so that the continuous loop formed by the legs 68, 69 extend a substantial distance underneath the stack of packaging bags when initially loaded into the storage area 53 of the packaging apparatus.

An important feature of this modification is the provision of slideable wicket retainers 72, 73 incorporated directly inside the wicket holder block 60. The wicket retainers 72, 73 are preferably U-shaped metal rods extending from the side wall of the block 60 into each groove 61, 62, respectively. The U-shaped retainer rods 72, 73 are adapted to move inside the block 60 in either direction as indicated by the arrows and thus can be employed to open and close the grooves 61, 62 when installing or removing a wicket. It will be readily seen that this embodiment eliminates the necessity for a separate wicket retainer.

It will be readily seen from the above description that the present invention provides an improved wicket bag packet which can incorporate a relatively large number of packaging bags without causing any serious misalignment problems. Further, the present invention provides an improved bag packet which permits a selected number of bags to be placed in position ready for use at the packaging station while the remaining bags are held apart in a separate storage area.

What is claimed is:

1. A wicket bag packet comprising, in combination:

(a) a stack of flattened, flexible packaging bags, each of said bags having an open end and having a pair of wicket holes provided in a portion thereof adjacent to said open end; and (b) a wicket including a substantially U-shaped rigid uper member having a pair of elongated leg sections adapted to pass through said pair of wicket holes provided in each bag and a substantially U-shaped flexible lower member having a pair of elongated leg sections extending through said pair of wicket holes provided in each bag and holding together the entire stack of packaging bags, said rigid upper member extending outwardly beyond said stack of packaging bags and having its elongated leg sections joined contiguously with the elongated leg sections of said flexible lower member forming a continuous loop whereby a selected number of bags may be taken from said stack of packaging bags and guided along said rigid upper member to a separate packaging location.

2. A wicket bag packet comprising, in combination:

(a) a stack of flattened, flexible packaging bags, each of said bags having an upper and a lower ply joined together along the edges thereof except at one edge forming a bag opening, said upper ply being shorter than said lower ply so as to clear said lower ply and provide a lip portion adjacent to said bag opening, said lip portion having a pair of wicket holes provided therein; and (b) a wicket including a substantially U-shaped rigid upper member having a straight horizontal center section adapted to bear down on the lip portion of each bag for holding said bag in place at a separate packaging station and having a pair of elongated leg sections adapted to pass through said pair of wicket holes provided in said lip portion of each bag and a substantially U-shaped, flexible lower binding member having a pair of elongated leg sections extending through said pair of wicket holes provided in each bag and holding together the entire stack of packaging bags, said rigid upper member extending outwardly beyond said stack of packaging bags and having its pair of elongated sections joined contiguously with the pair of leg sections on said flexible lower binding member forming a continuous loop whereby a selected number of bags may be taken from said stack of packaging bags and guided along said rigid upper member to said packaging station.

3. A wicket bag packet according to claim 2, wherein the flexible lower binding member is long enough to extend freely beyond the top or bottom or both of said stack of bags.

4. A wicket bag packet according to claim 2 wherein a tear slit is provided within said lip portion of each bag adjacent to said wicket holes for direction prone tearing.

* * * * *

UNITED STATES PATENT AND TRADEMARK OFFICE

CERTIFICATE OF CORRECTION

PATENT NO. : 4,519,504

DATED : May 28, 1985

INVENTOR(S) : Joseph A. Nausedas

It is certified that error appears in the above-identified patent and that said Letters Patent is hereby corrected as shown below:

In the Specification:

Column 4, line 26, insert the word "upper" between the words "The" and "ply".

In the Claims:

Column 9, line 23, "uper" should be --upper--.

Signed and Sealed this

*Eighth* Day of *October 1985*

[SEAL]

*Attest:*

DONALD J. QUIGG

*Attesting Officer*

*Commissioner of Patents and Trademarks—Designate*